US011160404B2

(12) United States Patent
Johnson

(10) Patent No.: US 11,160,404 B2
(45) Date of Patent: Nov. 2, 2021

(54) LID SLEEVE HOLDER

(71) Applicant: Neil Nathan Johnson, Waukee, IA (US)

(72) Inventor: Neil Nathan Johnson, Waukee, IA (US)

( * ) Notice: Subject to any disclaimer, the term of this patent is extended or adjusted under 35 U.S.C. 154(b) by 248 days.

(21) Appl. No.: 16/050,770

(22) Filed: Jul. 31, 2018

(65) Prior Publication Data

US 2020/0037799 A1 Feb. 6, 2020

(51) Int. Cl.
*B65D 81/38* (2006.01)
*A47G 23/02* (2006.01)

(52) U.S. Cl.
CPC ..... *A47G 23/0216* (2013.01)

(58) Field of Classification Search
CPC ..... A47G 23/0216; A47G 2023/0291; B65D 55/16; B65D 81/3876; B65D 81/3879; B65D 81/38; A61J 1/165; A61J 1/16
USPC ..... 220/735, 379, 738, 739, 903
See application file for complete search history.

(56) References Cited

U.S. PATENT DOCUMENTS 3,115,912 A * 12/1963 Harris ..... B25D 1/00 81/20
4,685,583 A * 8/1987 Noon ..... A47G 23/0216 220/710.5
5,205,473 A * 4/1993 Coffin, Sr. ..... B65D 3/22 206/813
5,425,497 A * 6/1995 Sorensen ..... A47G 23/0216 220/738
6,315,192 B1 11/2001 Marlow
6,343,735 B1 * 2/2002 Cai ..... B65D 81/3876 229/117.23
10,494,135 B2 * 12/2019 Pinson ..... B65D 85/62
2004/0070223 A1 * 4/2004 Wong ..... B32B 27/32 294/31.2
2004/0187662 A1 * 9/2004 Ulmer ..... B26F 1/24 83/39

(Continued)

FOREIGN PATENT DOCUMENTS

KR 20130073058 A 7/2013
KR 101619805 B1 5/2016
KR 101773131 B1 8/2017

OTHER PUBLICATIONS

"Vector Coffee Sleeves", http://www.vecteezy.com/vector-art/107199-vector-coffee-sleeves, accessed by Applicant Dec. 28, 2018.

(Continued)

*Primary Examiner* — King M Chu
(74) *Attorney, Agent, or Firm* — McKee, Voorhees & Sease, PLC

(57) ABSTRACT

A sleeve for a beverage holder having a lid including an outer surface, a thermally resistant, textured inner surface, and a perforation forming a tab movable between a first position flush with the outer surface and a second position extending outwardly from the outer surface. The tab is adapted to hold the lid in the second position. A method of using the sleeve includes encompassing a beverage holder with the sleeve, folding the tab into the second position, and suspending a lid of the beverage holder on the tab. A method of producing the sleeve includes providing a tool having a handle, and a head having a blade and teeth, and punching the blade and the teeth of the head into the sleeve to form the perforation.

17 Claims, 7 Drawing Sheets

(56) References Cited

U.S. PATENT DOCUMENTS

| | | | | |
|---|---|---|---|---|
| 2004/0262483 | A1 | 12/2004 | Hsieh | |
| 2006/0144915 | A1* | 7/2006 | Sadlier | B65D 3/22 229/403 |
| 2010/0200603 | A1 | 8/2010 | Kim et al. | |
| 2012/0111875 | A1* | 5/2012 | Johnson | A47G 23/0216 220/629 |
| 2016/0270575 | A1* | 9/2016 | Panone | A47G 21/145 |
| 2016/0309935 | A1* | 10/2016 | Chuang | A47G 23/0216 |
| 2016/0361190 | A1* | 12/2016 | Caden | A61F 5/028 |

OTHER PUBLICATIONS

Johnson, Neil Nathan, "The International Search Report and the Written Opinion of the International Searching Authority, or the Declaration", in connection with PCT/US2019/044044 filed Jul. 30, 2019, 16 pages, dated Oct. 31, 2019.

* cited by examiner

LID SLEEVE HOLDER

FIELD OF THE INVENTION

The present invention relates generally to an apparatus for use in the commercial food industry or for personal use. More particularly, but not exclusively, the present invention relates to a lid sleeve holder having a tab for suspending a lid of a cup for holding beverages.

BACKGROUND OF THE INVENTION

The commercial food industry is plagued with sanitation issues, many of which are outside of the control of the commercial food vendor. For example, self-service stations at coffee shops, restaurants, gas stations, or any other commercial business where beverages are served become contaminated with germs from spills, human debris, etc. And, to make matters worse, trash receptacles, condiments, and additives associated with other food products are often at the same self-service beverage station or are in close proximity to the same self-service beverage station. These things may contaminate a beverage if they contact the consumer, beverage, or beverage holding device.

In order to add desired food products to their beverage of choice, a consumer currently has to put the lid on a germ-infested countertop, causing the lid to become contaminated with germs. These germs may, in turn, make the consumer sick.

Consumers are limited in their options to remedy this dilemma. For example, a consumer may instead choose to put the lid on a napkin or in another location the consumer deems to be cleaner than the countertop of the self-service station. However, there is no guarantee the napkin or an alternative location does not also carry an equal or greater number of germs. Furthermore, the use of consumables, such as napkins, is ultimately wasteful, thereby costing the commercial vendor and customer more money, and ultimately harming the environment.

Thus, there exists a need in the art for a mechanical apparatus which eliminates contact between the lid of a cup and the countertop of a self-service station and is easily accessible to each and every consumer.

SUMMARY OF THE INVENTION

Therefore, it is a primary object, feature, or advantage of the present invention to improve on or overcome the deficiencies in the art.

It is still yet a further object, feature, or advantage of the present invention to provide an apparatus that may be used in a wide variety of applications. For example, the present invention may be used with cups holding both hot and cold beverages; cups of different shapes and sizes; cups made from a variety of different materials; and beverage holding devices other than cups, such as mugs or glassware.

It is still yet a further object, feature, or advantage of the present invention to provide an apparatus that is safe to use.

It is still yet a further object, feature, or advantage of the present invention to provide an apparatus that reduces waste by eliminating the need for napkins and other consumables associated with cleaning up a mess.

It is still yet a further object, feature, or advantage of the present invention to an apparatus that is cost effective.

It is still yet a further object, feature, or advantage of the present invention to provide an apparatus that is reliable and durable and has a long usable life.

It is still yet a further object, feature, or advantage of the present invention to provide an apparatus which may be easily used and reused.

It is still yet a further object, feature, or advantage of the present invention to provide an apparatus that can be easily manufactured, assembled, disassembled, replaced, stored, and cleaned.

It is still yet a further object, feature, or advantage of the present invention to provide an apparatus that is aesthetically pleasing.

It is still yet a further object, feature, or advantage of the present invention to incorporate an apparatus into a system which accomplishes some or all of the previously stated objectives.

It is still yet a further object, feature, or advantage of the present invention to provide methods of using and manufacturing an apparatus which accomplish some or all of the previously stated objectives.

It is still yet a further object, feature, or advantage of the present invention to provide a tool capable of making an apparatus which accomplishes all of the previously stated objectives.

The following provides a list of aspects and/or embodiments disclosed herein and does not limit the overall disclosure. It is contemplated that any of the embodiments disclosed herein can be combined with other embodiments, either in full or partially, as would be understood from reading the disclosure.

According to some aspects of the present disclosure, a sleeve for a beverage holder includes an outer surface, a thermally resistant, textured inner surface, and a perforation forming a tab movable between a first position flush with the outer surface and a second position extending outwardly from the outer surface, the tab adapted to hold the lid in the second position.

According to some additional aspects of the present disclosure, the perforation is half-moon shaped.

According to some additional aspects of the present disclosure, the perforation is rectangular.

According to some additional aspects of the present disclosure, the perforation is wave shaped.

According to some additional aspects of the present disclosure, the tab includes a hook or clip.

According to some additional aspects of the present disclosure, the tab includes an emblem or logo.

According to some additional aspects of the present disclosure, the sleeve comprises a paper or cardboard material.

According to some additional aspects of the present disclosure, the sleeve comprises a metallic alloy and the tab includes a means for retaining the tab in an original position or an engaged position.

According to some additional aspects of the present disclosure, the sleeve comprises silicone rubber or plastic.

According to some additional aspects of the present disclosure, the sleeve is for a generally cylindrical beverage holder.

According to some additional aspects of the present disclosure, the inner surface is corrugated.

According to some additional aspects of the present disclosure, the inner surface is smooth.

According to some additional aspects of the present disclosure, the inner surface is a mesh.

According to some additional aspects of the present disclosure, inner surface is checkered.

According to some other aspects of the present disclosure, the sleeve is used in combination with a cup and a lid.

According to some other aspects of the present disclosure, a method of using the sleeve includes encompassing a beverage holder with the sleeve, ripping or cutting the perforation, folding the tab into the second position, and suspending a lid of the beverage holder on the tab.

According to some additional aspects of the present disclosure, the method further includes removing any waste material from the sleeve.

According to some additional aspects of the present disclosure, the method further includes returning the tab to an original position after suspending the lid of the beverage holder on the tab.

According to some additional aspects of the present disclosure, the method further includes identifying the producer or vendor of the sleeve or the beverage holder via a mark, emblem, or logo located on the tab.

According to some other aspects of the present disclosure, a method of producing the sleeve includes providing a tool having a handle and a head having a blade and teeth and punching the blade and the teeth of the head into the sleeve to form the perforation.

These or other objects, features, and advantages of the present invention will be apparent to those skilled in the art after reviewing the following detailed description of the illustrated embodiments, accompanied by the attached drawings.

BRIEF DESCRIPTION OF THE DRAWINGS

FIG. 1A indicates the path of motion in which a consumer removes the lid from the cup and suspends the lid using a tab located on the sleeve. FIG. 1A also shows the angle at which the tab protrudes from the sleeve during suspension of the lid. FIG. 1B illustrates the cup and lid sleeve holder during suspension of the lid.

Figure 1A:
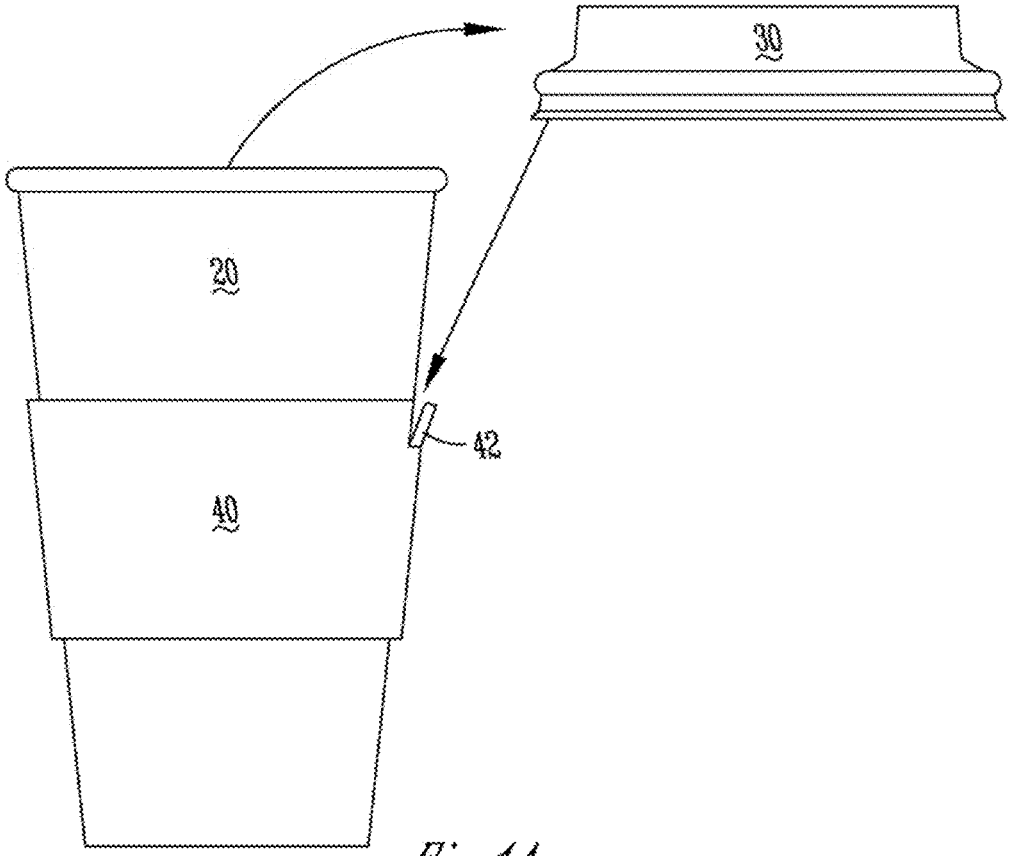
FIGS. 1A-1B show a front elevation view of a cup and lid sleeve holder, according to some aspects of the present disclosure.

Various embodiments of the present disclosure illustrate specific embodiments in which the present invention may be practiced. These embodiments of the present invention will be described in detail with reference to the drawings, wherein like reference numerals represent like parts throughout the several views. Reference to various embodiments does not limit the scope of the present disclosure and the drawings represented herein are presented for exemplary purposes.

DETAILED DESCRIPTION OF THE INVENTION

The following definitions and introductory matters are provided to facilitate an understanding of the present invention.

The terms "a," "an," and "the" include plural referents unless context clearly indicates otherwise. Similarly, the word "or" is intended to include "and" unless context clearly indicate otherwise. The word "or" means any one member of a particular list and also includes any combination of members of that list.

The terms "invention" or "present invention" as used herein are not intended to refer to any single embodiment of the particular invention but encompass all possible embodiments as described in the specification and the claims.

The term "about" as used herein refers to variation in the numerical quantities that can occur, for example, through typical measuring techniques and equipment, with respect to any quantifiable variable, including, but not limited to, mass, volume, time, distance, wave length, frequency, voltage, current, and electromagnetic field. Further, given solid and liquid handling procedures used in the real world, there is certain inadvertent error and variation that is likely through differences in the manufacture, source, or purity of the ingredients used to make the compositions or carry out the methods and the like. The claims include equivalents to the quantities whether or not modified by the term "about."

The term "configured" describes an apparatus, system, or other structure that is constructed or configured to perform a particular task or adopt a particular configuration. The term "configured" can be used interchangeably with other similar phrases such as constructed, arranged, adapted, manufactured, and the like.

Terms such as first, second, vertical, horizontal, top, bottom, upper, lower, front, rear, end, sides, concave, convex, and the like, are referenced according to the views presented. These terms are used only for purposes of description and are not limiting. Orientation of an object or a combination of objects may change without departing from the scope of the invention.

The following embodiments are described in sufficient detail to enable those skilled in the art to practice the invention however other embodiments may be utilized. Mechanical, procedural, and other changes may be made without departing from the spirit and scope of the invention. Accordingly, the scope of the invention is defined only by the appended claims, along with the full scope of equivalents to which such claims are entitled.

Figure 1B:
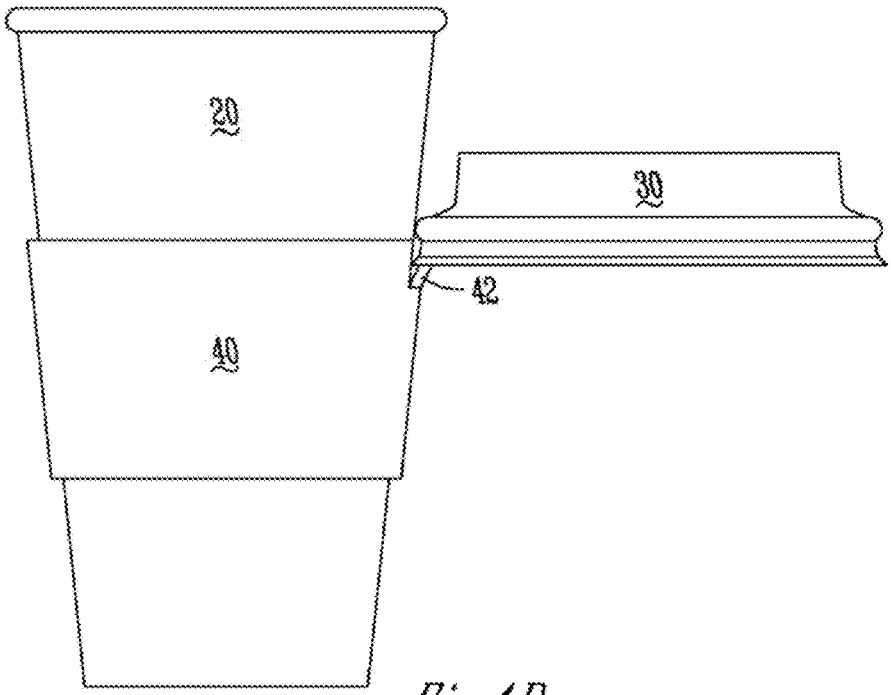

Referring now to the figures, FIGS. 1A-1B show a system including a cup for beverages 20, a lid 30, and a sleeve 40 encompassing the cup for beverages 20. The cup for beverages 20 does not necessarily need to be a cup. For example, mugs or glassware may be used in lieu of a cup. Additionally, the present invention is not limited to the use of a specific beverage but it is noted the present invention is well-suited for use within the commercial food industry and more specifically the commercial coffee industry where self-service stations are common.

FIG. 1A shows the path of motion in which a consumer removes a lid 30 from a cup for beverages 20 and suspends the lid 30 using a tab 42 located on the sleeve 40. An exemplary angle at which the tab 42 protrudes from the sleeve 40 during suspension of the lid 30 can also be seen in FIG. 1A. This angle is typically an acute angle and just barely protrudes from the surface of the sleeve 40 or the cup 20 such that the lid 30 has just enough room to wedge between the tab 42 and the sleeve 40 or the cup 20 however other angles may be used if the sleeve 40, the cup 20, or the lid 30 are particularly irregularly shaped.

FIG. 1B shows an exemplary angle at which the lid 30 is suspended from the side of the cup 20. This angle is typically an orthogonal angle because of the strength of the friction fit between the surface of the sleeve 40 or the cup 20 and the lid 30 however other angles may be used if the sleeve 40, the cup 20, or the lid 30 are particularly deformable or rigid. In these situations, a small hook or clip may be included within the tab 42 to help secure and suspend the lid 30 to the sleeve 40 or the cup 20.

Figure 2:
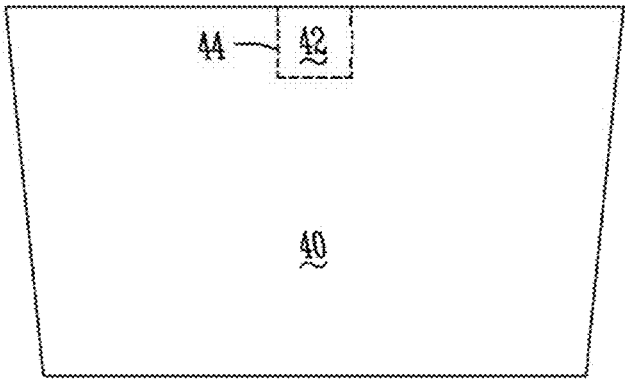
FIG. 2 shows a front elevation view of a sleeve having a first exemplary perforation to form a first exemplary tab, according to some aspects of the present disclosure. The perforation as shown is a rectangular cut located at the upper edge of the sleeve.
Figure 3:
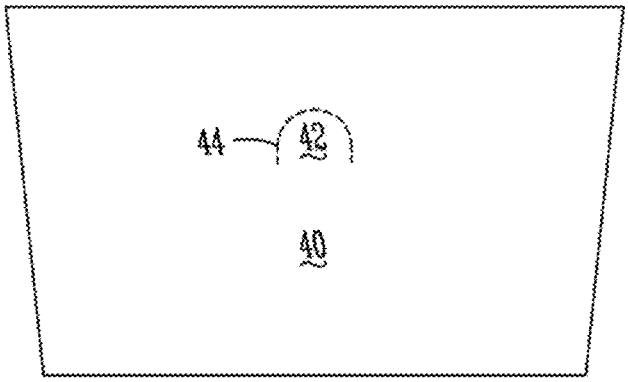
FIG. 3 shows a front elevation view of a sleeve having a second exemplary perforation to form a second exemplary tab, according to some aspects of the present disclosure. The perforation as shown is a half-moon shaped cut located near the center of the sleeve.
Figure 4:
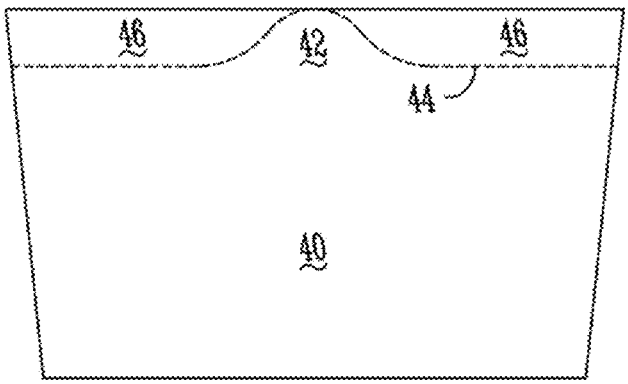
FIG. 4 shows a front elevation view of a sleeve having a third exemplary perforation to form a third exemplary tab, according to some aspects of the present disclosure. The perforation as shown is a wave shaped cut located at the upper edge of the sleeve.

FIGS. 2-4 show exemplary perforations 44 that form exemplary tabs 42. The perforation 44 as shown in FIG. 2 is a rectangular cut located at the upper edge of the sleeve. The perforation 44 as shown in FIG. 3 is a half-moon shaped cut located near the center of the sleeve 40. The perforation 44 as shown in FIG. 4 is a wave shaped cut located at the upper edge of the sleeve 40. The perforation 44 of FIG. 4 spans the entire length or approximately the entire length of the sleeve 40 such that waste material 46 is created after ripping or cutting the perforation 40 for use of the resulting tab 42 of the sleeve 44. Longer perforations 44 may include a fold, string, or other similar device to provide a starting point for the tear and to facilitate easier ripping of the perforation 40.

As mentioned in the brief description of the drawings, the designs for the tab are merely exemplary, and elements from the perforation 44 shown in one figure may be substituted, added, or removed from the elements of the perforation 44 shown in another figure. Additionally, other known shapes could be utilized for the perforation 44, so long as the resulting tab 42 retains the ability to suspend and secure the lid 30. For example, the wave shaped cut could potentially include multiple "waves," the rectangular cut could be located in the middle of the sleeve 40, and the half-moon shaped cut could approximated by a polygonal cut have many sides (such as a hexagonal or octagonal cut).

Figure 5:
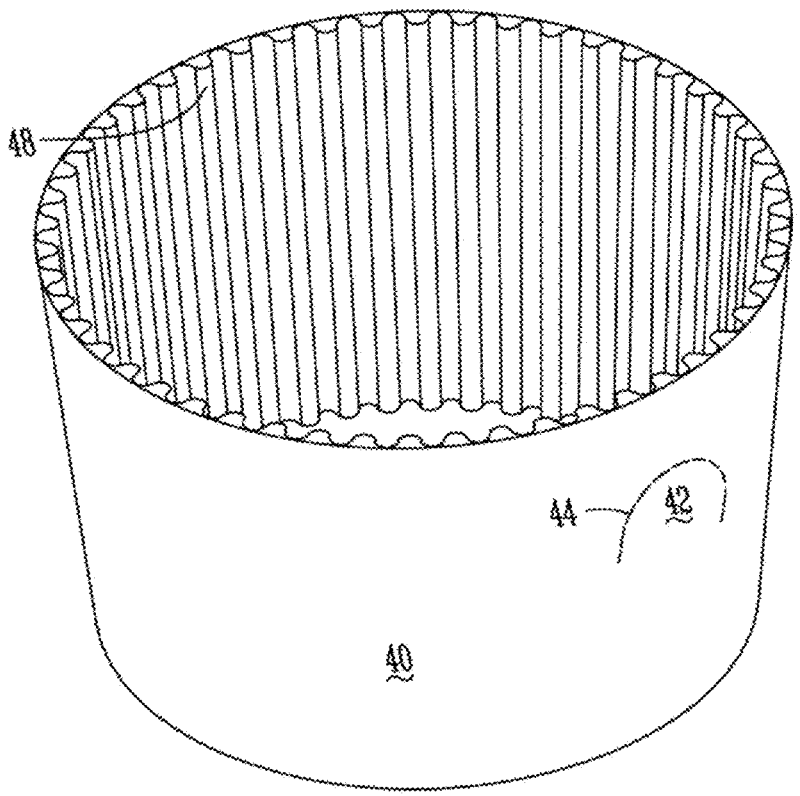
FIG. 5 shows a top perspective view of a corrugated sleeve with the second exemplary perforation and second exemplary perforated tab, according to some aspects of the present disclosure.

FIG. 5 shows only the sleeve 40. As such, the inner surface 48 of the sleeve 40 may be easily seen. The inner surface 48 of the sleeve 40 is typically a thermally resistant, textured inner surface. Such textures may include a corrugated texture as is shown, a smooth or checkered texture, a bumpy texture, a mesh, or any other textures known to prevent a consumer from being harmed (via freezing or burning) from holding a cup 20 or to prevent the sleeve 40 from slipping with respect to a cup 20 while being held by a consumer. The sleeve 40 may be tapered or otherwise shaped to better conform to the outer surface of the cup 20. The sleeve 40 may comprise a low-cost, recyclable material such as paper or cardboard material. Alternatively, the sleeve 40 may comprise a metallic alloy for increased durability and reuse. In such an embodiment, the tab 42 may include a means for retaining the tab in an original position or an engaged position, such as a snap, lock, detent, buckle, or any other known device capable of toggling or resisting movement.

Alternatively, the sleeve 40 may comprise silicone rubber, plastic, fiber, ceramic, or any other known polymer having molecular structure built up chiefly or completely from a large number of similar units bonded together, e.g., many synthetic organic materials. These polymers are particularly advantageous in that many of them can be easily washed in residential and commercial washers and dishwashing machines.

Figure 6:
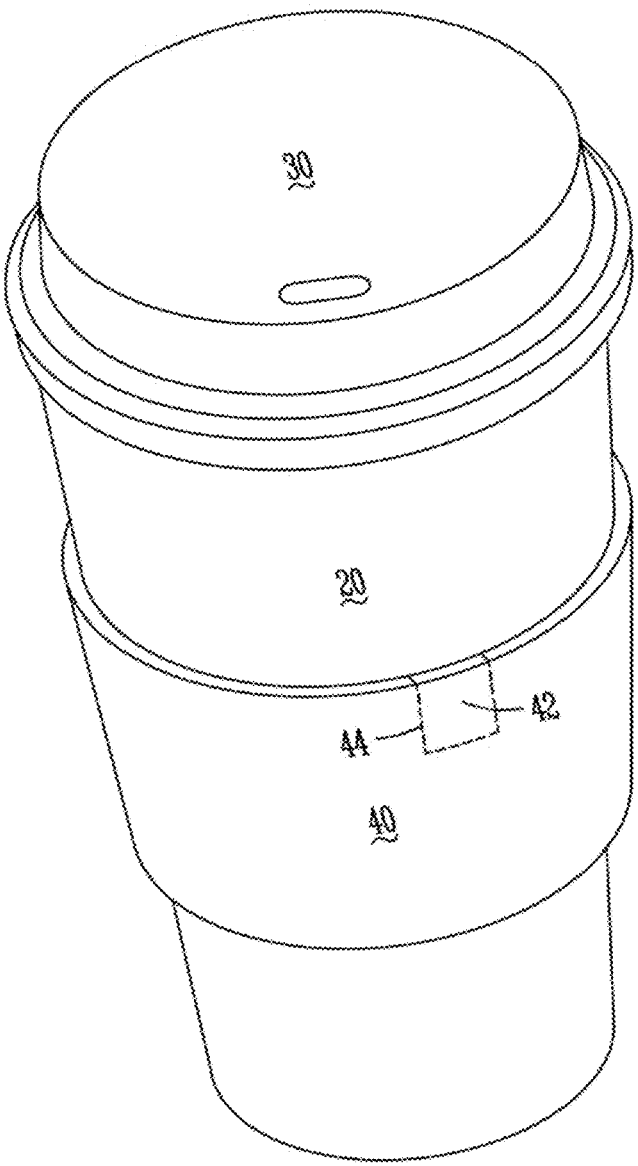
FIG. 6 illustrates a cup and lid sleeve holder prior to the first exemplary perforation being ripped or cut, prior to the first exemplary tab being folded out such that the tab protrudes from the cup, and prior to suspension of the lid, according to some aspects of the present disclosure.

FIG. 6 shows a cup 20, a lid 30, and a lid sleeve holder prior to the first exemplary perforation 44 (a rectangular cut located at the top of the sleeve 40) being ripped or cut, prior to the first exemplary tab 42 being folded out such that the tab 42 protrudes from the cup 20, and prior to suspension of the lid 30.

Figure 7:
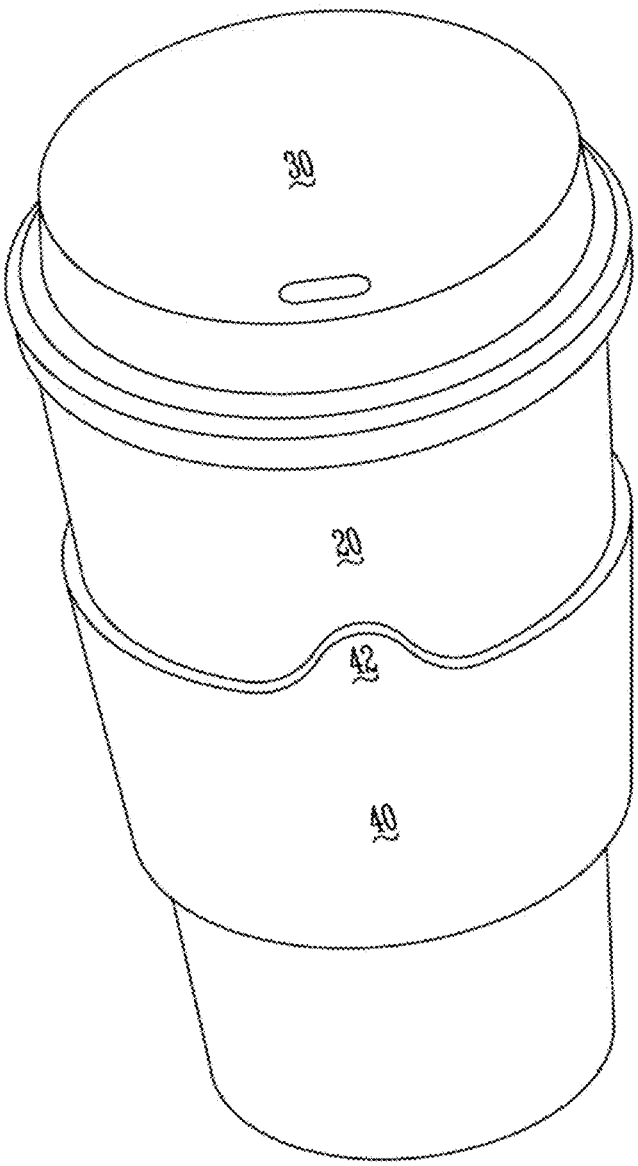
FIG. 7 illustrates a cup and lid sleeve holder after the third exemplary perforation is ripped or cut, prior to the third exemplary tab being folded out such that the tab protrudes from the cup, and prior to suspension of the lid, according to some aspects of the present disclosure.

FIG. 7 shows a cup 20, a lid 30, and a lid sleeve holder after the third exemplary perforation 44 (a wave shaped at located at the top of the sleeve 40) is ripped or cut, prior to the third exemplary tab 42 being folded back such that the tab protrudes from the cup 20, and prior to suspension of the lid 30.

Figure 8:
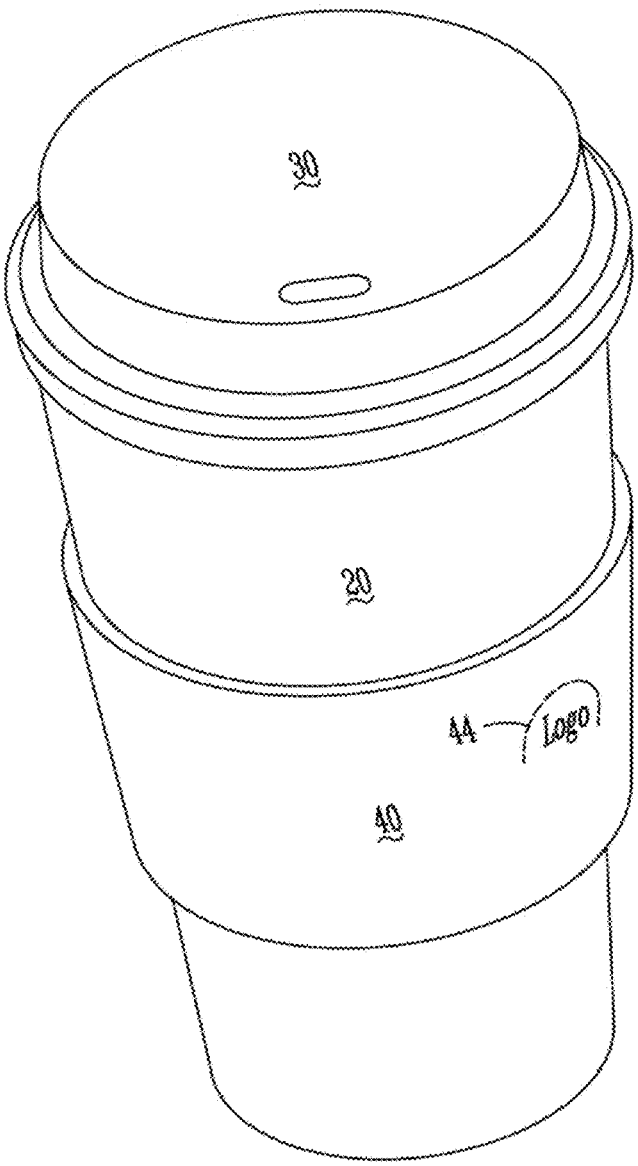
FIG. 8 illustrates a cup and lid sleeve holder prior to the second exemplary perforation being ripped or cut, prior to the second exemplary tab being folded out such that the tab protrudes from the cup, and prior to suspension of the lid, according to some aspects of the present disclosure.

FIG. 8 shows a cup 20, a lid 30, and a lid sleeve holder prior to the second exemplary perforation being ripped or cut, prior to the second exemplary tab 42 being folded out such that the tab 42 protrudes from the cup, and prior to suspension of the lid 30. Also shown in FIG. 8 is the use of a mark, logo, or emblem on the surface of the tab 42 identifying the producer or vendor of the sleeve or the beverage holder.

To use the cup 20, lid 30, and lid sleeve holder combination shown in the Figures, a consumer may encompass a beverage holder 20 with the sleeve 30, fold the resulting tab 42 back by tearing the perforation 44 on the sleeve 40, and suspend or secure the lid 30 of the beverage holder 20 on the tab 42. Any waste material 48 formed during this process may be removed from the sleeve 40. Furthermore, in some embodiments, the consumer may return the tab 42 to an original position after suspending the lid 30 of the beverage holder 20 on the tab 42.

Figure 9:
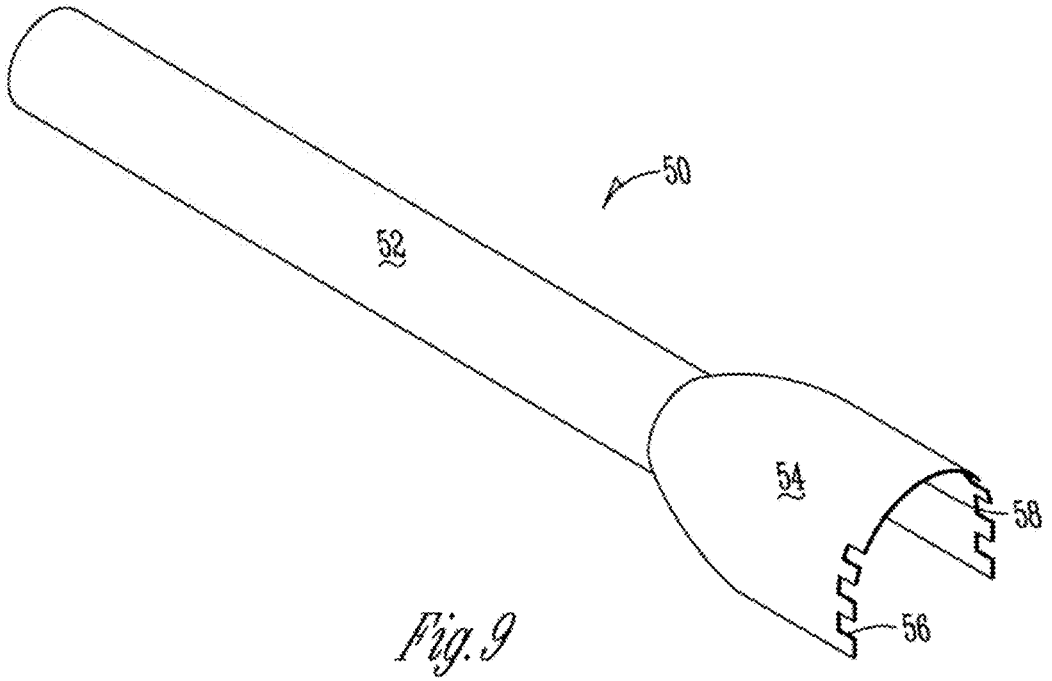
FIG. 9 shows a top perspective view of a tool used to make the second exemplary perforation shown in FIG. 3, according to some aspects of the present disclosure.
Figure 10:
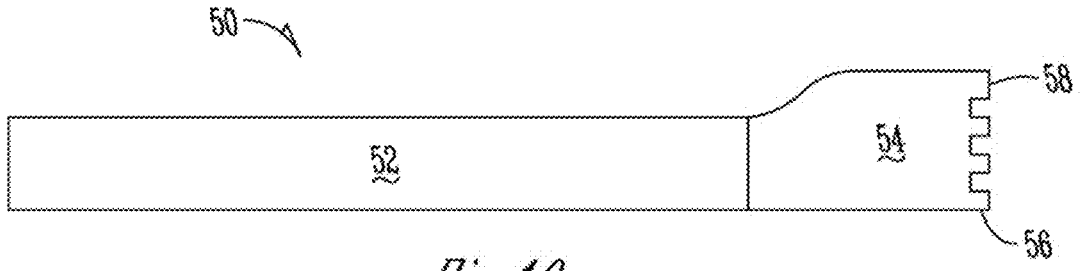
FIG. 10 shows a front elevation view of a tool used to make the second exemplary perforation shown in FIG. 3, according to some aspects of the present disclosure.
Figure 11:
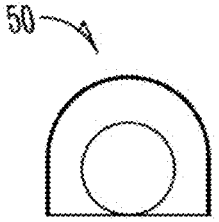
FIG. 11 shows a side elevation view of a tool used to make the second exemplary perforation shown in FIG. 3, according to some aspects of the present disclosure.

FIGS. 9-11 show a tool for producing the sleeve 40 which includes a handle 52, a head 54, a blade 56, and teeth 58.

The handle 52 is operatively (e.g., mechanically, chemically, magnetically, etc.) attached to the head 54 and may be partially or completely enclosed within the head 54. The handle 52 may take any known shape to assist the user in punching the blade 56 and the teeth 58 of the head 54 into the sleeve 40 to form the perforation. A non-limiting example of which would be a cylindrical shaft, as is shown in FIGS. 9-11. The handle 52 may comprise any material which assists the user in gripping the tool 50, such as knurling, specially shaped grooves, partially adhesive substances, any other materials known gripping mechanisms, or any combination thereof to facilitate gripping the handle. For example, a rubber handle may be used to improve grip if the tool 50 is intended for use by a person.

The tool 50 may also be adapted for use with a machine that automates punching, such as a punch press at high speeds on an assembly line. Using such a high-speed punch press will allow the head 54, blade 56, and teeth 58 to interact with the surface in a way that will alter the surface of the sleeve 40 without destroying the same. Such a machine could be hand operated, or operated by a motor, such as an electric motor. The machine, for example, could be a handheld electrically powered punch press. Attaching the handle 52 to the punch press will cause the tool 50 to punch with the full force of the punch press, if necessary. However, other ways of punching using the tool are to be included and are envisioned as part of the disclosure, such as using the punch press to punch with a lower full than the punch press is fully capable. The perforation 44 could even be formed through the use of a laser.

If used in combination with a machine that automates punching, the machine that automates punching may include a power supply that outputs a particular voltage to a device or component or components of a device. The power supply could be a DC power supply, an AC power supply, a linear regulator, etc. The power supply may be configured with a microcontroller to receive power from other grid-independent power sources, such as a generator or solar panel. The power supply may include an emergency stop feature, also known as a "kill switch," to shut off the machine in an emergency. Any other safety mechanisms known to prevent injuries to users of the machine may also be included. The emergency stop feature or other safety mechanisms may need user input or may use automatic sensors to detect and determine when to take a specific course of action for safety purposes."

The input from a user interface ("UI") can be sent to the microcontroller to control operational aspects of a device and could include a combination of digital and analog input and/or output devices or any other type of UI input/output device required to achieve a desired level of control and monitoring for a device. A user interface is how the user interacts with a machine, and could be a digital interface, a command-line interface, a graphical user interface ("GUI") or any other way a user can interact with a machine. For example, the user interface module can include a display and input devices such as a touch-screen, knobs, dials, switches, buttons, etc. More specifically, the display could be a liquid crystal display ("LCD"), a light-emitting diode ("LED") display, an organic LED ("OLED") display, an electroluminescent display ("ELD"), a surface-conduction electron emitter display ("SED"), a field-emission display ("FED"), a thin-film transistor ("TFT") LCD, a bistable cholesteric reflective display (i.e., e-paper), etc. The user interface also can be configured with a microcontroller to display conditions or data associated with the main device in real-time or substantially real-time.

Referring back to the figures, the blade 56 and teeth 58 are sharp and thin to more easily cut the perforation 44 into the sleeve 40. The blade 56 and teeth 58 typically comprise a metallic alloy of sufficient strength to remain sharp and durable after repeated use. The teeth may either be flat (e.g., a "molar teeth" configuration, as is shown) or pointed (e.g., a "canine teeth" configuration, not shown). The blade 56 and teeth 58 may also be curved to more closely conform to an irregularly shaped surface, such as the concave surface of a coffee cup. This particular configuration is particularly advantageous over the conventional press punch because this configuration allows a user to more easily punch the perforation 44 into a sleeve 50 already slid over a cup 20.

According to other aspects of the disclosure, the tool 50 may also be referred to as a specially adapted punch. The tool 50 may be considered specially adapted because traditional punch press machines have not yet been adapted to punch the sleeve 40 once the sleeve 40 is already positioned on an irregularly shaped surface, such as the concave surface of a coffee cup. Accordingly, this gives the user greater customizability as the user may locate the perforation 44 wherever the user desires.

From the foregoing, it can be seen that the present invention accomplishes at least all of the stated objectives.

LIST OF REFERENCE NUMERALS

The following list of reference numerals is provided to facilitate an understanding and examination of the present disclosure and is not exhaustive. Provided it is possible to do so, elements identified by a numeral may be replaced or used in combination with any elements identified by a separate numeral. Additionally, numerals are not limited to the descriptors provided herein and include equivalent structures and other objects possessing the same function.

20 cup for beverages
30 lid
40 sleeve
42 tab
44 perforation
46 waste material
48 internal texture of the sleeve
50 tool for making perforation
52 handle
54 head
56 blade
58 teeth The present disclosure is not to be limited to the particular embodiments described herein. The following claims set forth a number of the embodiments of the present disclosure with greater particularity.

What is claimed is:

1. A sleeve for mitigating unnecessary contact with germs, said sleeve configured to encompass a beverage holder, said beverage holder having a removable lid, said sleeve comprising:

an outer surface;

information printed on the outer surface;

a thermally resistant, textured inner surface; and a perforation forming a tab movable between a first position flush with the outer surface and a second position extending outwardly from the outer surface;

wherein the tab can be folded downwardly from the sleeve at an acute angle such that the tab is adapted to hold the lid in a position where the lid extends away from the beverage holder at an orthogonal angle while the tab is in the second position; and wherein a secured friction fit between the beverage holder and the lid can be accomplished by wedging the lid between the tab and the beverage holder while the tab is in the second position.

2. The sleeve of claim 1 wherein the perforation comprises a curve.

3. The sleeve of claim 1 wherein the perforation spans along a circumference of the beverage holder.

4. The sleeve of claim 1 wherein the sleeve comprises a paper or cardboard material.

5. The sleeve of claim 1 wherein the sleeve comprises a metallic alloy.

6. The sleeve of claim 1 wherein the sleeve comprises silicone rubber or plastic.

7. The sleeve of claim 1 wherein the sleeve is for a generally cylindrical beverage holder.

8. The sleeve of claim 1 wherein the thermally resistant, textured inner surface is corrugated.

9. The sleeve of claim 1 wherein the thermally resistant, textured inner surface is a mesh.

10. The sleeve of claim 1 wherein the thermally resistant, textured inner surface is checkered.

11. The sleeve of claim 1 in combination with the beverage holder and the lid.

12. The sleeve of claim 1 wherein the sleeve encompasses the beverage holder.

13. A method of using a sleeve for mitigating unnecessary contact with germs, said sleeve configured to encompass a beverage holder, said beverage holder having a removable lid, said sleeve comprising: an outer surface; information printed on the outer surface; a thermally resistant, textured inner surface; and a perforation forming a tab movable between a first position flush with the outer surface and a second position extending outwardly from the outer surface; wherein the tab can be folded downwardly from the sleeve at an acute angle such that the tab is adapted to hold the lid in a position where the lid extends away from the beverage holder at an orthogonal angle while the tab is in the second position; and wherein a secured friction fit between the beverage holder and the lid can be accomplished by wedging the lid between the tab and the beverage holder while the tab is in the second position, comprising:

encompassing the beverage holder with the sleeve;

folding or ripping the tab into the second position; and wedging the lid of the beverage holder between the tab and the sleeve.

14. The method of claim 13 further comprising returning the tab to the first position after (i) suspending the lid of the beverage holder on the tab, (ii) adding desired food products to a beverage, and (iii) removing the lid from the beverage holder.

15. The method of claim 13 further comprising identifying the producer or vendor of the sleeve or the beverage holder via a mark, emblem, or logo.

16. The method of claim 13 wherein wedging the lid of the beverage holder between the tab and the sleeve finishes ripping of the tab into the second position.

17. A method of modifying a sleeve for mitigating unnecessary contact with germs, said sleeve configured to encompass a beverage holder, said beverage holder having a removable lid, said sleeve comprising: an outer surface; information printed on the outer surface; a thermally resistant, textured inner surface; and a perforation forming a tab movable between a first position flush with the outer surface and a second position extending outwardly from the outer surface; wherein the tab can be folded downwardly from the sleeve at an acute angle such that the tab is adapted to hold the lid in a position where the lid extends away from the beverage holder at an orthogonal angle while the tab is in the second position; and wherein a secured friction fit between the beverage holder and the lid can be accomplished by wedging the lid between the tab and the beverage holder while the tab is in the second position, comprising:

providing a tool comprising:

a handle; and a head having a blade and teeth; and punching the blade and the teeth of the head into the sleeve to form the perforation.

* * * * *